US011142911B2

(12) United States Patent
Chen et al.

(10) Patent No.: US 11,142,911 B2
(45) Date of Patent: Oct. 12, 2021

(54) CONNECTION STRUCTURE, CONCRETE-ENCASED CONCRETE-FILLED STEEL TUBE COLUMN AND CONSTRUCTION METHOD

(71) Applicant: North China University of Science and Technology, Hebei (CN)

(72) Inventors: Jianwei Chen, Hebei (CN); Zhanwen Wang, Hebei (CN); Xiaoqing Song, Hebei (CN); Tao Yang, Hebei (CN); Jiushun Yao, Hebei (CN)

(73) Assignee: NORTH CHINA UNIVERSITY OF SCIENCE AND TECHNOLOGY

( * ) Notice: Subject to any disclaimer, the term of this patent is extended or adjusted under 35 U.S.C. 154(b) by 0 days.

(21) Appl. No.: 16/901,250

(22) Filed: Jun. 15, 2020

(65) Prior Publication Data

US 2020/0392732 A1 Dec. 17, 2020

Related U.S. Application Data

(63) Continuation of application No. PCT/CN2019/095008, filed on Jul. 8, 2019.

(30) Foreign Application Priority Data

Jun. 17, 2019 (CN) ..... 201910519725.4

(51) Int. Cl.
*E04C 3/34* (2006.01)
*E04B 1/58* (2006.01)

(52) U.S. Cl.
CPC ..... *E04C 3/34* (2013.01); *E04B 1/58* (2013.01); *E04B 2001/5875* (2013.01)

(58) Field of Classification Search
None
See application file for complete search history.

(56) References Cited

U.S. PATENT DOCUMENTS 1,973,741 A * 9/1934 Bauer ..... E04C 3/34 52/651.07
2,948,995 A * 8/1960 Myles ..... E04B 1/21 52/259

(Continued)

FOREIGN PATENT DOCUMENTS

CN 204753844 11/2015
CN 106351401 1/2017

(Continued)

OTHER PUBLICATIONS

International Search Report and Written Opinion dated Mar. 6, 2020 issued in corresponding International PCT Application No. PCT/CN2019/095008.

*Primary Examiner* — Joshua K Ihezie
(74) *Attorney, Agent, or Firm* — Onello & Mello, LLP

(57) ABSTRACT

The present invention discloses a concrete-encased concrete-filled steel tube (CFST) column connection structure, a concrete-encased CFST column comprising such a connection structure, and a construction method for constructing such a concrete-encased CFST column, in the technical field of connection of concrete-encased CFST columns. Exposed steel tubes at the connection ends of two split concrete-encased CFST columns are connected through a core positioning sleeve of a concrete-encased CFST column connection structure. Exposed longitudinal bars of the two split concrete-encased CFST columns are connected through longitudinal bar sleeves of the concrete-encased CFST column connection structure. A space between the two split concrete-encased CFST columns is sealed by an external sealing sleeve of the concrete-encased CFST column connection structure; and the space in the external sealing sleeve and around the first and second exposed steel tubes is filled with a concrete slurry.

20 Claims, 5 Drawing Sheets

(56) References Cited

U.S. PATENT DOCUMENTS

| | | | | | |
|---|---|---|---|---|---|
| 3,245,190 | A * | 4/1966 | Reiland | E04C 3/34 | 52/649.3 |
| 5,012,622 | A * | 5/1991 | Sato | E02D 5/30 | 52/263 |
| 5,174,080 | A * | 12/1992 | Yoshimura | E04B 1/215 | 52/252 |
| 5,367,854 | A * | 11/1994 | Kim | E04G 21/06 | 52/745.13 |
| 5,809,712 | A * | 9/1998 | Simanjuntak | E04C 5/08 | 52/223.7 |
| 8,474,204 | B2 * | 7/2013 | Pan | E04B 1/165 | 52/259 |
| 2009/0038263 | A1 * | 2/2009 | Douet | E04B 1/30 | 52/841 |
| 2010/0071315 | A1 * | 3/2010 | Hong | E04C 3/293 | 52/848 |
| 2011/0002744 | A1 * | 1/2011 | Tadros | E02D 5/523 | 405/232 |
| 2016/0097199 | A1 * | 4/2016 | Saiidi | E04C 3/36 | 52/126.7 |
| 2019/0078316 | A1 * | 3/2019 | Yin | E04B 1/24 | |

FOREIGN PATENT DOCUMENTS

| | | |
|---|---|---|
| CN | 108035439 | 5/2018 |
| CN | 109736438 | 5/2019 |
| JP | 0396544 | 4/1991 |
| JP | 2004190364 | 7/2004 |
| KR | 101615200 | 4/2016 |
| WO | 03054321 | 7/2003 |

* cited by examiner

CONNECTION STRUCTURE, CONCRETE-ENCASED CONCRETE-FILLED STEEL TUBE COLUMN AND CONSTRUCTION METHOD

CROSS REFERENCE TO RELATED APPLICATIONS

The present application claims the benefit of priority to International (PCT) patent application No. PCT/CN2019/095008, filed Jul. 8, 2019, which patent application claims priority to Chinese patent application 201910519725.4, filed Jun. 17, 2019, the contents of which applications are incorporated herein by reference.

TECHNICAL FIELD

The present invention relates to the technical field of concrete-encased concrete-filled steel tube (CFST) columns, to structures comprising a plurality of such columns and a connection structure, and in particular to a construction method for constructing a concrete-encased CFST column connection structure to connect two or more such columns such as two split concrete-encased CFST columns.

BACKGROUND

Concrete-encased CFST columns advantageously combine the characteristics of steel tubes and concrete. A concrete-encased CFST column typically has high bearing capacity and a relatively small cross-sectional size. Because the CFST column is isolated from the outside world by the concrete encasement, the concrete-encased CFST column has good fire resistance and corrosion resistance. The concrete-encased CFST column also has the advantages of good seismic performance, ductility, convenient construction and low cost, among other benefits. Therefore, this type of column has been widely used in constructing high-rise buildings, bridges and other such large-span structures.

In practical applications, however, there are typically various complex construction requirements. Sometimes it is necessary to use connection nodes in connecting concrete-encased CFST columns, which requires connecting two split concrete-encased CFST columns together to ensure the requisite connection strength. However, at present, there is no acceptable and reliable connection structure that is capable of easily and soundly making such connections.

SUMMARY

In order to address the above-mentioned technical problems, the present invention provides a connection structure and a construction method for a concrete-encased concrete-filled steel tube (CFST) column. The present invention comprises setting a connection node in a concrete-encased CFST column structure.

To achieve the above purpose, the present invention provides the following technical solutions.

A connection structure for a concrete-encased CFST column according to this invention includes a core positioning sleeve, a plurality of longitudinal bar sleeves, a hoop restraining sleeve and an external sealing sleeve, wherein the core positioning sleeve is used to connect two exposed steel tubes that are aligned opposite to each other. An inner diameter of the core positioning sleeve is substantially the same as the outer diameters of the exposed steel tubes; and, a plurality of slurry-flowing holes are opened on a side wall of the core positioning sleeve to facilitate a concrete slurry inflow in the space between and surrounding the two exposed steel tubes. An inner side wall of the core positioning sleeve is circumferentially provided with a plurality of cushions for bracing the exposed steel tubes.

The plurality of longitudinal bar sleeves are each used to connect two exposed longitudinal bars that are aligned opposite to each other. An inner diameter of the longitudinal bar sleeve is larger than an outer diameter of the exposed longitudinal bars.

The hoop restraining sleeve is used to restrain the position of the core positioning sleeve and the longitudinal bar sleeves; and, each longitudinal bar sleeve is fixedly connected to an inner side wall of the hoop restraining sleeve. The hoop restraining sleeve is sleeved outside the core positioning sleeve and fixedly connected to an outer side wall of the core positioning sleeve through one or more first connection keys.

The external sealing sleeve is used to seal a space between a first split concrete-encased CFST column and a second split concrete-encased CFST column. The external sealing sleeve is sleeved outside the hoop restraining sleeve and fixedly connected to the hoop restraining sleeve through one or more second connection keys.

In some invention embodiments, the slurry-flowing holes and the cushions are arranged alternately at intervals along the circumferential direction of the core positioning sleeve.

The present invention further provides a concrete-encased CFST column including a first split concrete-encased CFST column, a second split concrete-encased CFST column and the concrete-encased CFST column connection structure as described above, wherein: the first split concrete-encased CFST column comprises first exposed longitudinal bars and a first exposed steel tube; and the second split concrete-encased CFST column comprises second exposed longitudinal bars and a second exposed steel tube.

Each first exposed longitudinal bar is connected to a corresponding aligned second exposed longitudinal bar through a longitudinal bar sleeve such that one end of the first exposed steel tube and one end of the second exposed steel tube are nested inside a core positioning sleeve and are respectively braced on both ends with cushions. An external sealing sleeve is provided between the first split concrete-encased CFST column and the second concrete-encased CFST column; and, one end of the external sealing sleeve is connected to one end of the first split concrete-encased CFST column, while the other end of the external sealing sleeve is connected to one end of the second split concrete-encased CFST column. One of the split concrete-encased CFST columns is provided with an outlet port, and the other split concrete-encased CFST column is provided with a grouting port.

In some invention embodiments, the external sealing sleeve is provided with at least an observation hole.

In some invention embodiments, the concrete-encased CFST column further includes first stirrup rings for tightening a plurality of first exposed longitudinal bars and second stirrup rings for tightening a plurality of second exposed longitudinal bars, where the first stirrup rings are provided along a length direction of the first exposed longitudinal bars, and the second stirrup rings are provided along a length direction of the second exposed longitudinal bars.

In some invention embodiments, the first exposed steel tube and the second exposed steel tube are each provided with at least a first shear key on an outer side wall, and the external sealing sleeve is provided with at least a second shear key on an inner side wall. The first shear key enhances adhesion between the first exposed steel tube and the second exposed steel tube and the slurry, and the second shear key enhances adhesion between the external sealing sleeve and the slurry.

In some invention embodiments, one end of the first split concrete-encased CFST column is provided with a first sealing boss nested inside one end of the external sealing sleeve, and one end of the second split concrete-encased CFST column is provided with a second sealing boss nested inside the other end of the external sealing sleeve.

In some invention embodiments, the first split concrete-encased CFST column, the external sealing sleeve and the second split concrete-encased CFST column when connected form a column with a rectangular parallelepiped configuration.

The present invention further provides a construction method for constructing the above-described connection structure and the associated concrete-encased CFST column, including the following steps:

step 1: assembling the concrete-encased CFST column connection structure comprising: fixing one end of the first connection key to an outer side wall of the core positioning sleeve and the other end to an inner side wall of the hoop restraining sleeve; fixing one end of the second connection key to an outer side wall of the hoop restraining sleeve and the other end to an inner side wall of the external sealing sleeve; and fixing each longitudinal bar sleeve to an inner side wall of the hoop restraining sleeve;

step 2: nesting the first exposed longitudinal bars and the second exposed longitudinal bars respectively inside the corresponding longitudinal bar sleeves; bracing the first exposed steel tube and the second exposed steel tube respectively on both ends with the cushions; and connecting the two ends of the external sealing sleeve to the first split concrete-encased CFST column and the second split concrete-encased CFST column, respectively; and step 3: injecting the concrete slurry into the external sealing sleeve through the grouting port until the slurry fills the space in the external sealing sleeve and around the first exposed steel tube and the second exposed steel tube.

Compared with the prior art, the present invention achieves the following advantageous technical effects:

The present invention provides a concrete-encased CFST column connection structure, a concrete-encased CFST column and a concrete-encased CFST column construction method. Exposed steel tubes of two split concrete-encased CFST columns are connected through a core positioning sleeve of a concrete-encased CFST column connection structure. Exposed longitudinal bars of the two split concrete-encased CFST columns are connected through longitudinal bar sleeves of the concrete-encased CFST column connection structure. A space between the two split concrete-encased CFST columns is sealed by an external sealing sleeve of the concrete-encased CFST column connection structure. Spaces in the external sealing sleeve and around a first exposed steel tube and a second exposed steel tube are filled with slurry. The concrete-encased CFST column connection structure provided by the present invention is used to connect two split concrete-encased CFST columns by setting a connection node in the concrete-encased CFST column while ensuring the connection strength.

BRIEF DESCRIPTION OF DRAWINGS

To describe the technical solutions in the examples of the present invention or in the prior art more clearly, the accompanying drawings are briefly described below. It should be understood that the accompanying drawings and the following drawing descriptions show merely some examples of the present invention, and a person of ordinary skill in the art may still derive other drawings from these accompanying drawings without creative efforts, which also should be deemed to be within the scope of this invention.

Figure 1:
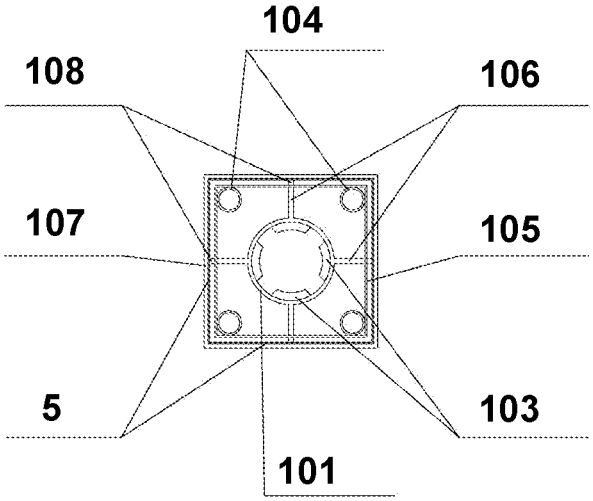
FIG. 1 is a schematic lateral cross-sectional structural diagram of a connection structure of a concrete-encased concrete-filled steel tube (CFST) column according to the present invention.

The reference numerals used in FIGS. 1-5 are identified as follows:

concrete-encased CFST column connection structure (1); core positioning sleeve (101); slurry-flowing holes (102); cushions (103); longitudinal bar sleeves (104); hoop restraining sleeve (105); first connection keys (106); external sealing sleeve (107); second connection keys (108); first split concrete-encased CFST column (2); first exposed steel tube (201); first exposed longitudinal bars (202); first stirrup rings (203); first sealing boss (204); outlet port (205); second split concrete-encased CFST column (3); second exposed steel tube (301); second exposed longitudinal bars (302); second stirrup rings (303); second sealing boss (304); grouting port (305); first shear keys (4); second shear keys (5); and observation hole (6).

DETAILED DESCRIPTION

The technical solutions in the examples of the present invention are clearly and completely described with reference to the accompanying drawings. It should be understood, however, that the described examples are merely some rather than all of the examples of the present invention. All other examples obtained by a person of ordinary skill in the art based on the examples of the present invention without creative efforts are intended to also fall within the scope of protection of the present invention.

An objective of the present invention is to provide a connection structure, a concrete-encased concrete-filled steel tube (CFST) column comprising the connection structure, and a construction method thereof. The present invention comprises setting a connection node in a concrete-encased CFST column as a connection structure for two aligned split CFST columns.

In order to describe the above objectives, features, and advantages of the present invention more clearly, the present invention is described in further detail below with reference to the accompanying drawings and specific implementations.

Example 1

Figure 2:
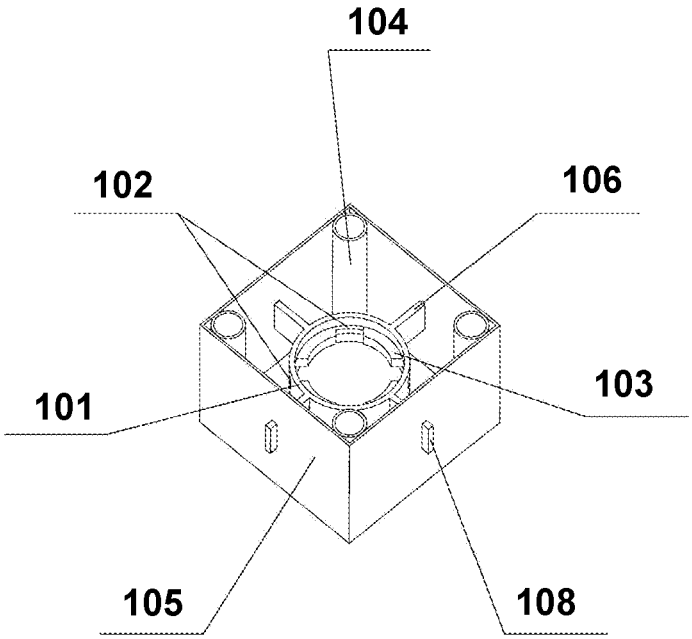
FIG. 2 is a schematic isometric view of a concrete-encased CFST column connection structure according to the present invention.

This example provides a concrete-encased CFST column connection structure 1 (FIG. 5), other views of which are shown in FIGS. 1-2. Connection structure 1 comprises a core positioning sleeve 101, longitudinal bar sleeves 104, a hoop restraining sleeve 105 and an external sealing sleeve 107 (shown in FIG. 1 but not in FIG. 2).

Figure 5:
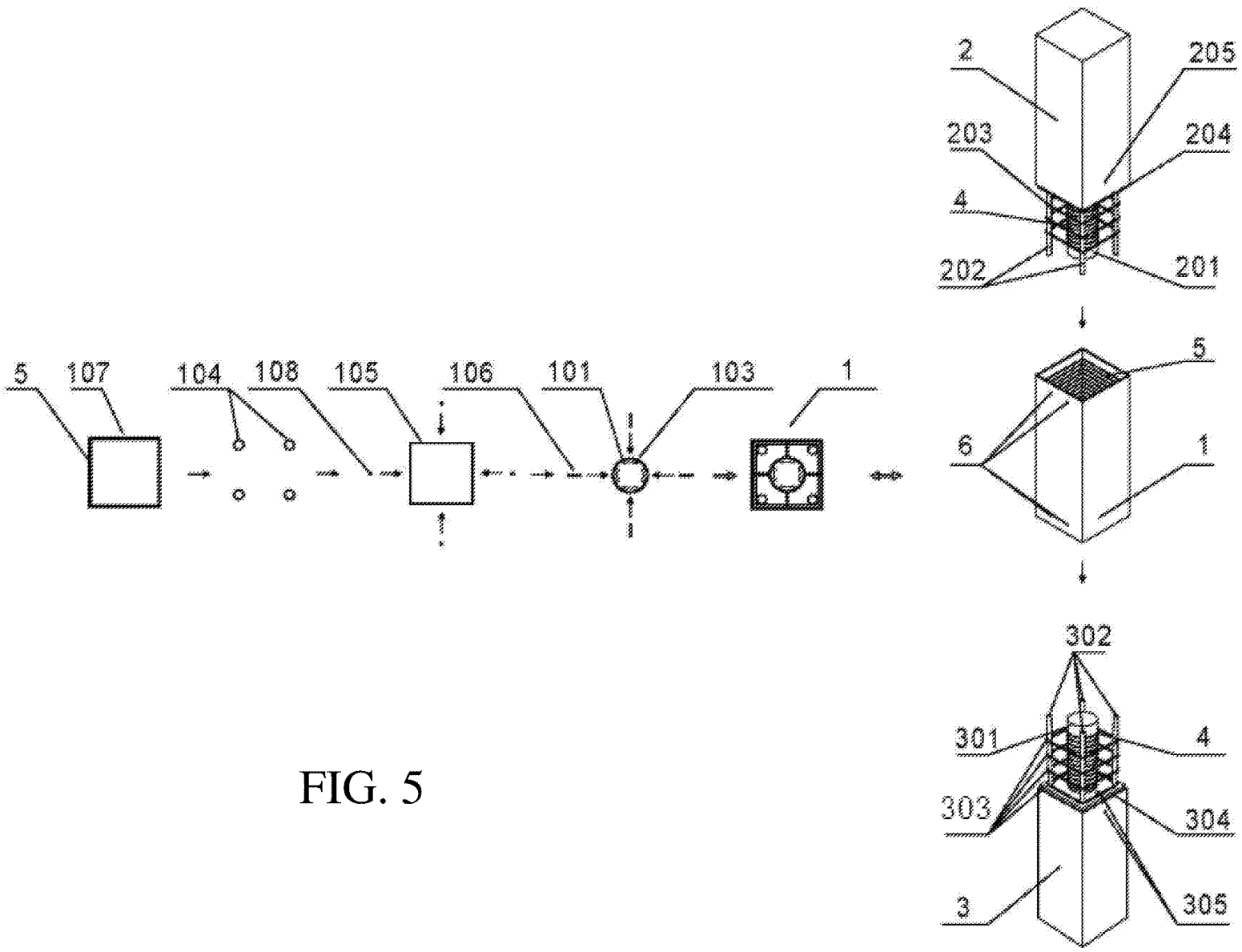
FIG. 5 is a schematic drawing illustrating assembly of the components of a concrete-encased CFST column structure according to the present invention.

The core positioning sleeve 101 of connection structure 1 is used to connect ends of two exposed steel tubes positioned opposite to each other (as illustrated in FIG. 5)—i.e., an end-to-end connection. An inner diameter of the core positioning sleeve 101 is substantially the same as an outer diameter of each of the two exposed steel tubes that are being connected. A plurality of slurry-flowing holes 102 (FIG. 2) are opened on a side wall of the core positioning sleeve 101 to facilitate the slurry inflow between the two exposed steel tubes after the connection has been made. An inner side wall of the core positioning sleeve 101 is circumferentially provided with a plurality of cushions 103 for bracing the exposed steel tubes that are being connected. In this example, there are four slurry-flowing holes 102 and four cushions 103 (although only some of these can be seen in FIG. 2).

A plurality of longitudinal bar sleeves 104 are used to connect the longitudinal bars projecting respectively from the connection ends of the two CFST columns that are being connected (FIG. 5). An inner diameter of each longitudinal bar sleeve 104 is slightly larger than an outer diameter of each exposed longitudinal bar. In this example, there are four exposed longitudinal bars on the connection end of each of the two CFST columns (a total of eight exposed longitudinal bars) and four longitudinal bar sleeves 104. The longitudinal bars are positioned to mate with the respective longitudinal bar sleeves when the longitudinal bars of the two CFST columns are aligned (FIG. 5).

The hoop restraining sleeve 105 is used to restrain the position of the core positioning sleeve 101 and the longitudinal bar sleeves 104. Each longitudinal bar sleeve 104 is fixedly connected to an inner side wall of the hoop restraining sleeve 105 (FIGS. 1 and 2). The hoop restraining sleeve 105 is sleeved outside the core positioning sleeve 101 and fixedly connected to an outer side wall of the core positioning sleeve 101 through a plurality of first connection keys 106. Specifically, there are four first connection keys 106 in FIGS. 1 and 2. A cushion 103 is symmetrically association with each first connection key 106 along the inner face of core positioning sleeve 101. In order to make the connection stronger, the ends of the first connection keys 106 are flush with the respective ends of the core positioning sleeve 101.

The external sealing sleeve 107 (FIG. 1) is used to seal a space between a first split concrete-encased CFST column 2 and a second split concrete-encased CFST column 3 (FIG. 5). The external sealing sleeve 107 is sleeved outside the hoop restraining sleeve 105 and fixedly connected to the hoop restraining sleeve 105 through a plurality of second connection keys 108 (FIG. 2). Specifically, there are the same number of first connection keys 106 and second connection keys 108 positioned on opposite sides of sleeve 105. The ends of the first connection keys 106 are flush with the respective ends of the second connection keys 108.

In order to save space and facilitate grouting, the slurry-flowing holes 102 and the cushions 103 are arranged alternately at intervals along the circumferential direction of the core positioning sleeve 101 (FIG. 2).

In operation, the respective exposed steel tubes 201 and 301 of the two split concrete-encased CFST columns 2 and 3 are connected through the core positioning sleeve 101 of the concrete-encased CFST column connection structure 1. The respective exposed longitudinal bars 202 and 302 of the two split concrete-encased CFST columns 2 and 3 are connected through the longitudinal bar sleeves 104 of the concrete-encased CFST column connection structure 1. A space between the two split concrete-encased CFST columns is sealed by the external sealing sleeve 107 of the concrete-encased CFST column connection structure 1. A space inside the external sealing sleeve 107, which includes first exposed steel tube 201 and second exposed steel tube 301, is filled with slurry. The concrete-encased CFST column connection structure 1 provided by this example is used to longitudinally connect two split concrete-encased CFST columns end-to-end (as shown in FIG. 5), and it hides a connection node in the concrete-encased CFST column without the need for a formwork while ensuring the connection strength.

Example 2

Figure 3:
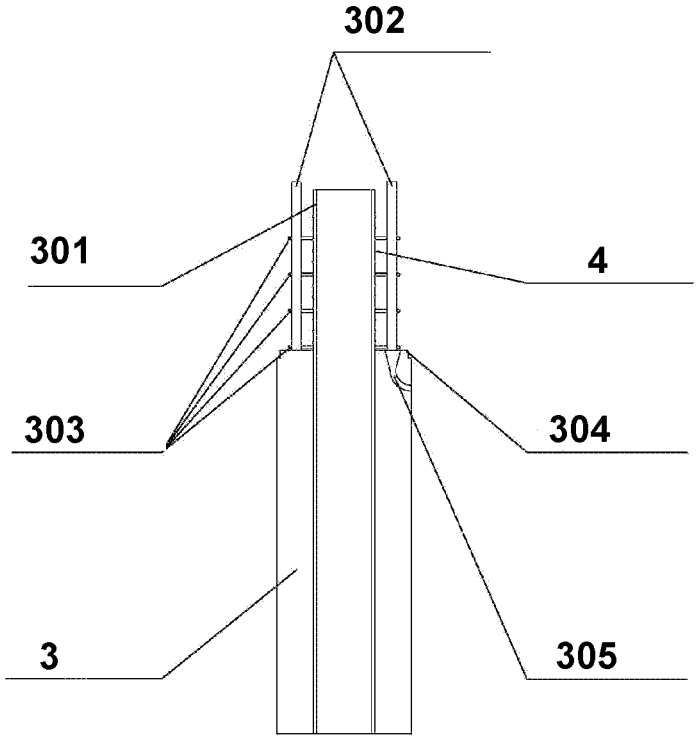
FIG. 3 is a schematic longitudinal sectional view of a second split concrete-encased CFST column according to the present invention.
Figure 4:
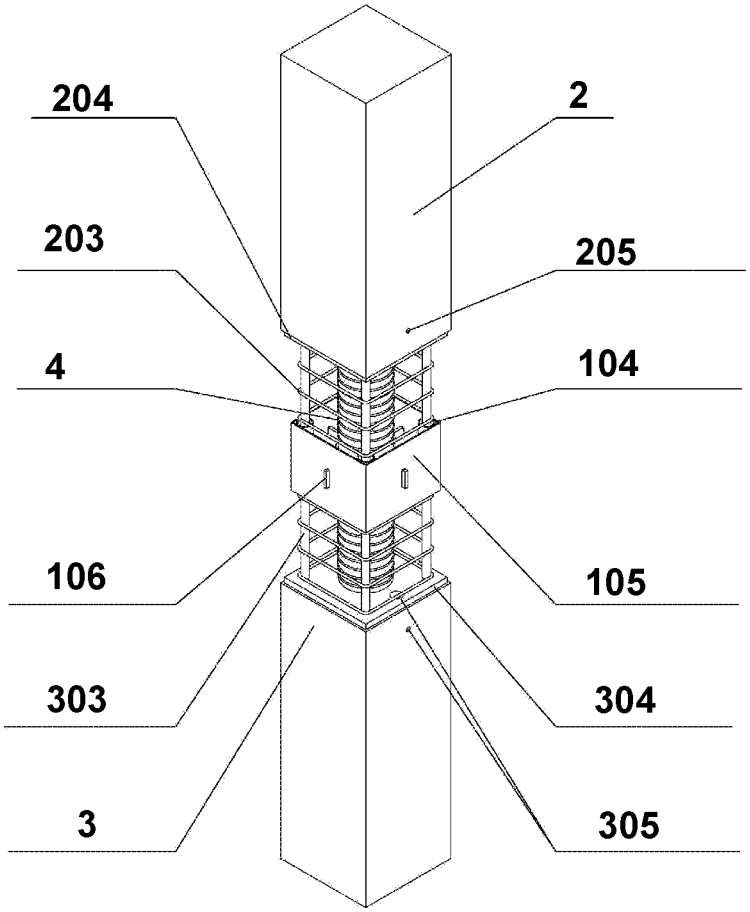
FIG. 4 is a schematic isometric, partially cutaway diagram showing an internal structure of a concrete-encased CFST column according to the present invention.

This example provides additional description for forming a connected concrete-encased CFST column, as shown in FIGS. 3-5, comprising a first split concrete-encased CFST column 2, a second split concrete-encased CFST column 3, and a concrete-encased CFST column connection structure 1. The drawings show exposed longitudinal bars 202 of the first split concrete-encased CFST column 2 and the exposed steel tube 201 of the first split concrete-encased CFST column 2. They also show the exposed longitudinal bars 302 of the second split concrete-encased CFST column 3 and an exposed steel tube 301 of the second split concrete-encased CFST column 3. Specifically, in this example, there are four first exposed longitudinal bars 202 and four second exposed longitudinal bars 302.

A first exposed longitudinal bar 202 is connected to a corresponding second exposed longitudinal bar 302 through one of the longitudinal bar sleeves 104. One end of the first exposed steel tube 201 and one end of the second exposed steel tube 301 are nested inside a core positioning sleeve 101, and respectively braced on both ends by the cushions 103. An external sealing sleeve 107 is provided between the first split concrete-encased CFST column 2 and the second concrete-encased CFST column 3. One end of the external sealing sleeve 107 is connected to a connection end of the first split concrete-encased CFST column 2, and the other end of the external sealing sleeve 107 is connected to a connection end of the second split concrete-encased CFST column 3. The first split concrete-encased CFST column 2 is provided with an outlet port 205, and the second split concrete-encased CFST column 3 is provided with a grouting port 305. Specifically, the grouting port 305 is a tapered grouting port, and the outlet port 205 is a tapered outlet port.

In this example, in order to facilitate external observation of the internal grouting condition of the external sealing sleeve 107 during the connecting and slurry filling procedure, an observation hole 6 is provided on the external sealing sleeve 107 of the concrete-encased CFST column. Specifically, the observation hole 6 is provided at upper and lower ends of the external sealing sleeve, and there are two observation holes 6 on each end.

In order to improve the strength and stability of the concrete-encased CFST column, the concrete-encased CFST column further includes first stirrup rings 203 for tightening a plurality of first exposed longitudinal bars 202 and second stirrup rings 303 for tightening a plurality of second exposed longitudinal bars 302. A plurality of the first stirrup rings 203 are provided along a length direction of the first exposed longitudinal bars 202, and a plurality of the second stirrup rings 303 are provided along a length direction of the second exposed longitudinal bars 302.

In order to enhance the adhesion with the slurry, the first exposed steel tube 201 and the second exposed steel tube 301 are each provided with at least a first shear key 4 on an outer side wall, and the external sealing sleeve 107 is provided with at least a second shear key 5 on an inner side wall. Specifically, the first shear key 4 is a first shear key ring, and the second shear key 5 is a second shear key ring. The first shear key 4 is arranged along a height direction of the first exposed steel tube 201 and the second exposed steel tube 301, and the second shear key 5 is arranged along a height direction of the external sealing sleeve 107. The part of the first exposed steel tube 201 and the second exposed steel tube 301 nested inside the core positioning sleeve 101 is not provided with the first shear key 4, and the part of the external sealing sleeve 107 connected with the first split concrete-encased CFST column 2 and the second concrete-encased CFST column 3 is not provided with the second shear key 5.

In order to prevent the leakage of grout around the connections between the external sealing sleeve 107 and the first split concrete-encased CFST column 2 and the second split concrete-encased CFST column 3 during grouting, a connection end of the first split concrete-encased CFST column 2 is provided with a first sealing boss 204 nested inside the corresponding end of the external sealing sleeve 107, and a connection end of the second split concrete-encased CFST column 3 is provided with a second sealing boss 304 nested inside the other end of the external sealing sleeve 107.

In addition, specifically, the first split concrete-encased CFST column 2, the external sealing sleeve 107 and the second split concrete-encased CFST column 3 together form a connected column with a rectangular parallelepiped configuration. The hoop restraining sleeve 105 has a rectangular cross section, and each side of the hoop restraining sleeve 105 is parallel to a corresponding side of the external sealing sleeve 107. The four longitudinal bar sleeves 104 are located at the four inner corners of the rectangular hoop retaining sleeve 105, respectively.

A construction method for constructing the concrete-encased CFST column comprises the following steps:

Step 1: assembling the concrete-encased CFST column connection structure 1 comprising: welding one end of the first connection key 106 to an outer side wall of the core positioning sleeve 101 and the other end to an inner side wall of the hoop restraining sleeve 105; welding one end of the second connection key 108 to an outer side wall of the hoop restraining sleeve 105 and the other end to an inner side wall of the external sealing sleeve 107; and welding each longitudinal bar sleeve 104 to an inner side wall at a corner of the hoop restraining sleeve 105.

Step 2: nesting the first exposed longitudinal bars 202 and the second exposed longitudinal bars 302 respectively inside the corresponding longitudinal bar sleeves 104; bracing the first exposed steel tube 201 and the second exposed steel tube 301 respectively on both ends with the cushions 103; connecting the two ends of the external sealing sleeve 107 to the first split concrete-encased CFST column 2 and the second split concrete-encased CFST column 3, respectively.

Step 3: injecting a slurry into the external sealing sleeve 107 through the grouting port 305 until the slurry fills the space in the external sealing sleeve 107 and around the first exposed steel tube 201 and the second exposed steel tube 301.

An existing concrete-encased CFST column is typically provided with a steel tube and longitudinal bars along a height direction thereof. The longitudinal bars are evenly arranged along a circumferential direction of the steel tube. Such an existing concrete-encased CFST column is formed by casting the steel tube, the longitudinal bars and concrete. A first split CFST column and a second split CFST column are two separate structures formed by the disconnection of an integral CFST column. After the integral CFST column is disconnected, the steel tube and the longitudinal bars that were originally wrapped inside the integral concrete column are partially exposed. The exposed parts of the steel tube and the longitudinal bars form exposed steel tubes and exposed longitudinal bars, respectively.

Specific examples are applied in this specification to describe the principle and implementations of the present invention. The description of the aforementioned examples, however, is intended only to be illustrative and for facilitating understanding of the method and the core idea of the present invention. It will be understood that for those of ordinary skills in the art, there may be changes in specific implementations and applications which are still considered within the scope of the present invention. In conclusion, the content of this specification should not be construed as a limitation of the present invention.

What is claimed is:

1. A concrete-encased concrete-filled steel tube (CFST) column connection structure comprising: a core positioning sleeve, a plurality of longitudinal bar sleeves, a hoop restraining sleeve and an external sealing sleeve, wherein:

the core positioning sleeve is sized and shaped to position and connect two exposed steel tubes opposite to each other; an inner diameter of the core positioning sleeve is substantially the same as an outer diameter of the exposed steel tubes; a plurality of slurry-flowing holes on a side wall of the core positioning sleeve facilitate a slurry inflow between the two exposed steel tubes positioned in the core positioning sleeve; and an inner side wall of the core positioning sleeve is circumferentially provided with a plurality of cushions for bracing the exposed steel tubes; and additionally wherein:

the plurality of longitudinal bar sleeves are sized and shaped to connect two exposed longitudinal bars opposite to each other; an inner diameter of the longitudinal bar sleeve is larger than an outer diameter of the exposed longitudinal bars;

the hoop restraining sleeve restrains the position of the core positioning sleeve and the longitudinal bar sleeves; each longitudinal bar sleeve is fixedly connected to an inner side wall of the hoop restraining sleeve; the hoop restraining sleeve is sleeved outside the core positioning sleeve and fixedly connected to an outer side wall of the core positioning sleeve through first connection keys; and, the external sealing sleeve seals a space between a first split concrete-encased CFST column and a second split concrete-encased CFST column when these columns are positioned in the core positioning sleeve; and the external sealing sleeve is sleeved outside the hoop restraining sleeve and fixedly connected to the hoop restraining sleeve through a second connection key.

2. The concrete-encased CFST column connection structure according to claim 1, wherein the slurry-flowing holes and the cushions are arranged at intervals along the circumferential direction of the core positioning sleeve.

3. A concrete-encased CFST column, comprising:

a first split concrete-encased CFST column, a second split concrete-encased CFST column and the concrete-encased CFST column connection structure according to claim 1, wherein the first split concrete-encased CFST column comprises first exposed longitudinal bars and a first exposed steel tube; and a second split concrete-encased CFST column comprises second exposed longitudinal bars and a second exposed steel tube, wherein:

each first exposed longitudinal bar connects to a second exposed longitudinal bar through a longitudinal bar sleeve;

a connection end of the first exposed steel tube and a connection end of the second exposed steel tube are nested inside the core positioning sleeve and respectively braced on both ends by a cushion;

the external sealing sleeve seals a space between the first split concrete-encased CFST column and the second concrete-encased CFST column;

one end of the external sealing sleeve is connected to the connection end of the first split concrete-encased CFST column, and the other end of the external sealing sleeve is connected to the connection end of the second split concrete-encased CFST column; and one of the split concrete-encased CFST columns is provided with an outlet port, and the other split concrete-encased CFST column is provided with a grouting port.

4. A concrete-encased CFST column, comprising:

a first split concrete-encased CFST column, a second split concrete-encased CFST column and the concrete-encased CFST column connection structure according to claim 2, wherein the first split concrete-encased CFST column comprises first exposed longitudinal bars and a first exposed steel tube; and a second split concrete-encased CFST column comprises second exposed longitudinal bars and a second exposed steel tube, wherein:

each first exposed longitudinal bar connects to a second exposed longitudinal bar through a longitudinal bar sleeve;

a connection end of the first exposed steel tube and a connection end of the second exposed steel tube are nested inside the core positioning sleeve and respectively braced on both ends by a cushion;

the external sealing sleeve seals a space between the first split concrete-encased CFST column and the second concrete-encased CFST column;

one end of the external sealing sleeve is connected to the connection end of the first split concrete-encased CFST column, and the other end of the external sealing sleeve is connected to the connection end of the second split concrete-encased CFST column; and one of the split concrete-encased CFST columns is provided with an outlet port, and the other split concrete-encased CFST column is provided with a grouting port.

5. The concrete-encased CFST column according to claim 3, wherein the external sealing sleeve is provided with at least an observation hole.

6. The concrete-encased CFST column according to claim 4, wherein the external sealing sleeve is provided with at least an observation hole.

7. The concrete-encased CFST column according to claim 3, further comprising first stirrup rings for tightening a plurality of first exposed longitudinal bars and second stirrup rings for tightening a plurality of second exposed longitudinal bars, wherein the first stirrup rings are provided along a length direction of the first exposed longitudinal bars, and the second stirrup rings are provided along a length direction of the second exposed longitudinal bars.

8. The concrete-encased CFST column according to claim 4, further comprising first stirrup rings for tightening a plurality of first exposed longitudinal bars and second stirrup rings for tightening a plurality of second exposed longitudinal bars, wherein the first stirrup rings are provided along a length direction of the first exposed longitudinal bars, and the second stirrup rings are provided along a length direction of the second exposed longitudinal bars.

9. The concrete-encased CFST column according to claim 3, wherein the first exposed steel tube and the second exposed steel tube are each provided with first shear keys on an outer side wall, and the external sealing sleeve is provided with second shear keys on an inner side wall, wherein the first shear keys enhance adhesion between the first and second exposed steel tubes respectively and the slurry, and the second shear keys enhance adhesion between the external sealing sleeve and the slurry.

10. The concrete-encased CFST column according to claim 4, wherein the first exposed steel tube and the second exposed steel tube are each provided with first shear keys on an outer side wall, and the external sealing sleeve is provided with second shear keys on an inner side wall, wherein the first shear keys enhance adhesion between the first and second exposed steel tubes respectively and the slurry, and the second shear keys enhance adhesion between the external sealing sleeve and the slurry.

11. The concrete-encased CFST column according to claim 3, wherein the connection end of the first split concrete-encased CFST column is provided with a first sealing boss nested inside a corresponding end of the external sealing sleeve, and the connection end of the second split concrete-encased CFST column is provided with a second sealing boss nested inside the other end of the external sealing sleeve.

12. The concrete-encased CFST column according to claim 4, wherein the connection end of the first split concrete-encased CFST column is provided with a first sealing boss nested inside a corresponding end of the external sealing sleeve, and the connection end of the second split concrete-encased CFST column is provided with a second sealing boss nested inside the other end of the external sealing sleeve.

13. The concrete-encased CFST column according to claim 3, wherein when connected the first split concrete-encased CFST column, the external sealing sleeve, and the second split concrete-encased CFST column form a column with a rectangular parallelepiped configuration.

14. The concrete-encased CFST column according to claim 4, wherein when connected the first split concrete-encased CFST column, the external sealing sleeve, and the second split concrete-encased CFST column form a column with a rectangular parallelepiped configuration.

15. A construction method for constructing the concrete-encased CFST column according to claim 3, comprising the following steps:

step 1: assembling the concrete-encased CFST column connection structure comprising: fixing one end of the first connection key to an outer side wall of the core positioning sleeve and the other end to an inner side wall of the hoop restraining sleeve; fixing one end of the second connection key to an outer side wall of the hoop restraining sleeve and the other end to an inner side wall of the external sealing sleeve; and fixing each longitudinal bar sleeve to an inner side wall of the hoop restraining sleeve;

step 2: nesting the first exposed longitudinal bars and the second exposed longitudinal bars respectively inside the corresponding longitudinal bar sleeves; bracing the first exposed steel tube and the second exposed steel tube respectively on both ends with the cushions; connecting the two ends of the external sealing sleeve to the first split concrete-encased CFST column and the second split concrete-encased CFST column, respectively; and step 3: injecting the slurry into the external sealing sleeve through the grouting port until the slurry fills the space in the external sealing sleeve and around the first exposed steel tube and the second exposed steel tube.

16. A construction method for constructing the concrete-encased CFST column according to claim 5, comprising the following steps:

step 1: assembling the concrete-encased CFST column connection structure comprising: fixing one end of the first connection key to an outer side wall of the core positioning sleeve and the other end to an inner side wall of the hoop restraining sleeve; fixing one end of the second connection key to an outer side wall of the hoop restraining sleeve and the other end to an inner side wall of the external sealing sleeve; and fixing each longitudinal bar sleeve to an inner side wall of the hoop restraining sleeve;

step 2: nesting the first exposed longitudinal bars and the second exposed longitudinal bars respectively inside the corresponding longitudinal bar sleeves; bracing the first exposed steel tube and the second exposed steel tube respectively on both ends with the cushions; connecting the two ends of the external sealing sleeve to the first split concrete-encased CFST column and the second split concrete-encased CFST column, respectively; and step 3: injecting the slurry into the external sealing sleeve through the grouting port until the slurry fills the space in the external sealing sleeve and around the first exposed steel tube and the second exposed steel tube.

17. A construction method for constructing the concrete-encased CFST column according to claim 7, comprising the following steps:

step 1: assembling the concrete-encased CFST column connection structure comprising: fixing one end of the first connection key to an outer side wall of the core positioning sleeve and the other end to an inner side wall of the hoop restraining sleeve; fixing one end of the second connection key to an outer side wall of the hoop restraining sleeve and the other end to an inner side wall of the external sealing sleeve; and fixing each longitudinal bar sleeve to an inner side wall of the hoop restraining sleeve;

step 2: nesting the first exposed longitudinal bars and the second exposed longitudinal bars respectively inside the corresponding longitudinal bar sleeves; bracing the first exposed steel tube and the second exposed steel tube respectively on both ends with the cushions; connecting the two ends of the external sealing sleeve to the first split concrete-encased CFST column and the second split concrete-encased CFST column, respectively; and step 3: injecting the slurry into the external sealing sleeve through the grouting port until the slurry fills the space in the external sealing sleeve and around the first exposed steel tube and the second exposed steel tube.

18. A construction method for constructing the concrete-encased CFST column according to claim 9, comprising the following steps:

step 1: assembling the concrete-encased CFST column connection structure comprising: fixing one end of the first connection key to an outer side wall of the core positioning sleeve and the other end to an inner side wall of the hoop restraining sleeve; fixing one end of the second connection key to an outer side wall of the hoop restraining sleeve and the other end to an inner side wall of the external sealing sleeve; and fixing each longitudinal bar sleeve to an inner side wall of the hoop restraining sleeve;

step 2: nesting the first exposed longitudinal bars and the second exposed longitudinal bars respectively inside the corresponding longitudinal bar sleeves; bracing the first exposed steel tube and the second exposed steel tube respectively on both ends with the cushions; connecting the two ends of the external sealing sleeve to the first split concrete-encased CFST column and the second split concrete-encased CFST column, respectively; and step 3: injecting the slurry into the external sealing sleeve through the grouting port until the slurry fills the space in the external sealing sleeve and around the first exposed steel tube and the second exposed steel tube.

19. A construction method for constructing the concrete-encased CFST column according to claim 11, comprising the following steps:

step 1: assembling the concrete-encased CFST column connection structure comprising: fixing one end of the first connection key to an outer side wall of the core positioning sleeve and the other end to an inner side wall of the hoop restraining sleeve; fixing one end of the second connection key to an outer side wall of the hoop restraining sleeve and the other end to an inner side wall of the external sealing sleeve; and fixing each longitudinal bar sleeve to an inner side wall of the hoop restraining sleeve;

step 2: nesting the first exposed longitudinal bars and the second exposed longitudinal bars respectively inside the corresponding longitudinal bar sleeves; bracing the first exposed steel tube and the second exposed steel tube respectively on both ends with the cushions; connecting the two ends of the external sealing sleeve to the first split concrete-encased CFST column and the second split concrete-encased CFST column, respectively; and step 3: injecting the slurry into the external sealing sleeve through the grouting port until the slurry fills the space in the external sealing sleeve and around the first exposed steel tube and the second exposed steel tube.

20. A construction method for constructing the concrete-encased CFST column according to claim 13, comprising the following steps:

step 1: assembling the concrete-encased CFST column connection structure comprising: fixing one end of the first connection key to an outer side wall of the core positioning sleeve and the other end to an inner side wall of the hoop restraining sleeve; fixing one end of the second connection key to an outer side wall of the hoop restraining sleeve and the other end to an inner side wall of the external sealing sleeve; and fixing each longitudinal bar sleeve to an inner side wall of the hoop restraining sleeve;

step 2: nesting the first exposed longitudinal bars and the second exposed longitudinal bars respectively inside the corresponding longitudinal bar sleeves; bracing the first exposed steel tube and the second exposed steel tube respectively on both ends with the cushions; connecting the two ends of the external sealing sleeve to the first split concrete-encased CFST column and the second split concrete-encased CFST column, respectively; and step 3: injecting the slurry into the external sealing sleeve through the grouting port until the slurry fills the space in the external sealing sleeve and around the first exposed steel tube and the second exposed steel tube.

* * * * *